United States Patent [19]

Dantlgraber

[11] Patent Number: 4,678,412

[45] Date of Patent: Jul. 7, 1987

[54] ADJUSTING APPARATUS FOR A VANE PUMP OR RADIAL PISTON PUMP

[75] Inventor: Jorg Dantlgraber, Lohr-Sackenbach, Fed. Rep. of Germany

[73] Assignee: Mannesmann Rexroth G.m.b.H., Lohr, Fed. Rep. of Germany

[21] Appl. No.: 833,511

[22] Filed: Feb. 21, 1986

Related U.S. Application Data

[63] Continuation of Ser. No. 564,956, Dec. 23, 1983, abandoned.

[30] Foreign Application Priority Data

Dec. 23, 1982 [DE] Fed. Rep. of Germany ..... 3247885

[51] Int. Cl.[4] ..... F04C 2/344; F04C 15/04; F04B 49/08

[52] U.S. Cl. ..... 418/26; 418/27; 418/31; 417/220

[58] Field of Search ..... 418/24–27, 418/31; 417/218, 220, 219

[56] References Cited

U.S. PATENT DOCUMENTS

| | | | |
|---|---|---|---|
| 2,635,551 | 4/1953 | De Lancey | 418/26 |
| 2,649,739 | 8/1953 | Hufferd et al. | 418/26 |
| 2,740,256 | 4/1956 | O'Malley | 418/26 |
| 3,656,869 | 4/1972 | Leonard | 418/26 |
| 3,687,579 | 8/1972 | Martin et al. | 418/27 |
| 3,756,749 | 9/1973 | Aldinger | 418/26 |
| 4,035,105 | 7/1977 | Dantlgraber | 418/26 |

FOREIGN PATENT DOCUMENTS

| | | |
|---|---|---|
| 49838 | 4/1982 | European Pat. Off. . |
| 1927074 | 12/1970 | Fed. Rep. of Germany . |
| 2157770 | 6/1972 | Fed. Rep. of Germany . |
| 2600918 | 8/1977 | Fed. Rep. of Germany . |
| 2614602 | 10/1977 | Fed. Rep. of Germany . |
| 2914282 | 10/1980 | Fed. Rep. of Germany . |
| 3122598 | 1/1983 | Fed. Rep. of Germany . |
| 2026094 | 1/1980 | United Kingdom . |

*Primary Examiner*—John J. Vrablik

*Attorney, Agent, or Firm*—Cushman, Darby & Cushman

[57] ABSTRACT

An adjusting arrangement for a vane or radial piston pump in which the forces applied outwardly to the cam ring are compensated by the application of hydraulic pressure to each of a plurality of sections about the ring. System pressure is applied to one section and a regulating pressure to another. A spring or hydraulic arrangement absorb any force differential.

32 Claims, 8 Drawing Figures

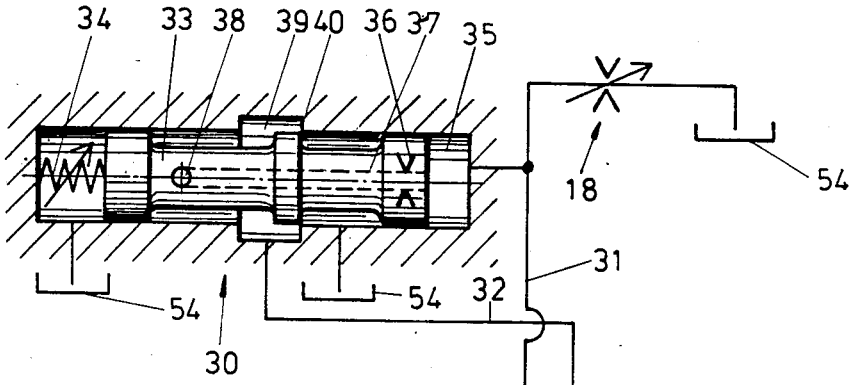
Fig 1
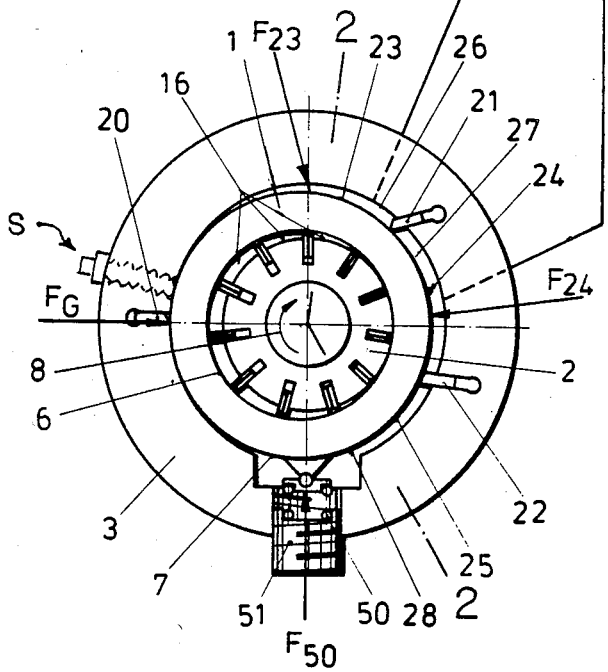
Fig 2
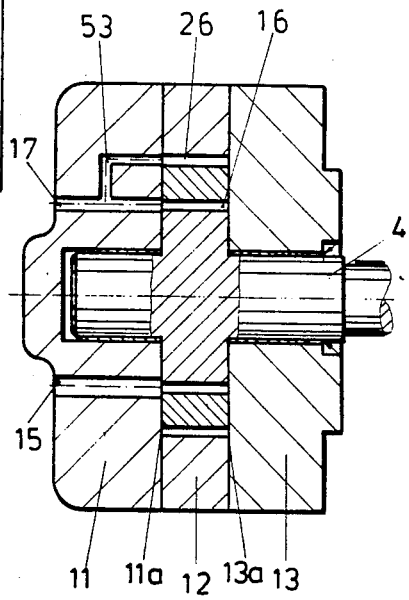

ADJUSTING APPARATUS FOR A VANE PUMP OR RADIAL PISTON PUMP

This is a continuation of application Ser. No. 564,956, filed Dec. 23, 1983 now abandoned, which was abandoned upon the filing hereon.

This invention relates to an apparatus for adjusting a vane pump or a radial piston pump.

From the German Pat. No. OS 23 57 102.6-15, an adjustable vane pump is known in which a cam ring is clamped at opposite sides by steering pistons operated hydraulically. Furthermore, the cam ring is supported by a pressure piece disposed in the pump housing which may be turned more or less inwards by a level adjusting screw. For example, in the case of rising pressure in the system, the level adjusting screw can be twisted to move the pressure element and with it also the cam ring inwards. The forces holding the cam ring in its desired position are applied mechanically.

One disadvantage is that high tensions occur because the adjusting forces are applied as point or line loads on the cam ring. Furthermore, the size of the two adjusting pistons must be selected such that, for maximum system pressure, damage to the cam ring is avoided. However, for low pressures, the force for the adjustment of the cam ring is not then sufficient for quick shifting.

An additional disadvantage of the known vane pump is that the changing forces of pressure occurring during operation of the pump are absorbed directly by the housing or by the level adjusting screw. Thus, any sound will be transferred directly to the outside surface of the housing emitting the sound, which leads to a high level of noise. Since the position of the centers of the cam ring and the rotor determine the triggering and steering away points, the optimal noise in the case of known vane pumps can be determined only for one operating point. Whenever, therefore, the vane pump is optimized for high pressure then, because of the pre-compression force, the regulating noise behavior will be worsened at low pressures. The same applies to the vane pumps.

According to the present invention a minimal level of noise is achieved at all points of operation.

This is achieved according to the present invention by applying compensating forces to the exterior of the cam ring by hydraulic pressure.

Further advantages, goals and details of the invention will result from the description of embodiments given by way of example on the basis of the drawing; in the drawing:

FIG. 1 shows a cross section through a vane pump developed according to the present invention;

FIG. 2 shows a section along the line 2—2 in FIG. 1;

In describing the five embodiments of the invention given by way of example, the same reference numbers are used for equal or essentially equal construction parts for the sake of simplification.

Figure 3:
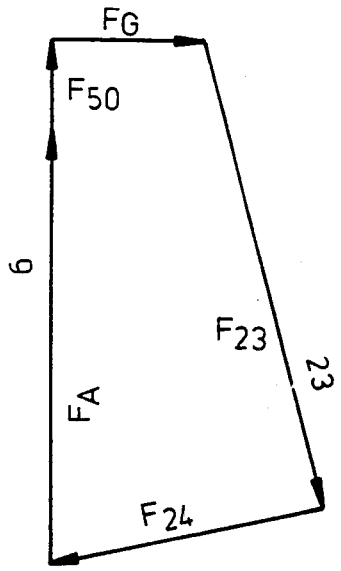
FIG. 3 is a force diagram of the force vectors at the cam ring at full supply of fluid by pump according to FIGS. 1 and 2.

The vane pump shown in the FIGS. 1 and 2 has a pump housing 3 as well as a rotor 2 which may be put into rotation by a shaft 4 disposed with torsional strength thereon in the direction of the arrow 8. In bores of rotor 2 which have not been illustrated in detail, blades are mounted. The ends of the blades are directed outward and slidably fit against the inner jacket surface 6 of a cam ring 1. The cam ring 1 is held within housing 3 in an adjustable manner at its outside jacket surface 7 as described below.

As shown in FIG. 2, housing 3 consists preferably of three parts, namely a top 11, a middle part 12 and a flange 13. Discs (not shown) provided with compression springs may be inserted loosely into the top 11 and the flange 13. These discs are supported by the plane faces of middle part 12. Middle part 12 is evacuated.

Whenever rotor 2 turns in the direction of arrow 8, hydraulic operating fluid will be fed from a tank 54 by way of a suction line 15 of a suction kidney (not shown) in the area of the lower crescent space, which is formed between rotor 2 and cam ring 1. The upper part of the crescent space forms a compression space 16 from which the now compressed operating fluid is fed at system pressure by a discharge kidney (not shown) to a discharge line 17. The discharge line 17 is connected with valve 18.

According to the present invention, the outside jacket surface 7 of the cam ring 1 is subdivided by three movable sealing elements into three jacket surface sections 23, 24 and 25 by sealing elements 20, 21, and 22. Thus, three sectional spaces or sectional chambers 26, 27 and 28 will always be defined between the inner surface of the housing and the outside jacket surface 7 of the cam ring 1. The sealing elements are disposed in the inside wall of the housing and their free ends fit sealingly against the outside of the cam ring. The sealing elements are guided sealingly on the side walls of the housing.

According to the invention, section chamber 26 is acted upon preferably by the system pressure of the pump, while to the adjacently located section chamber 27 is applied a pump regulating pressure produced by a conventional pump regulator 30. The section chamber 28 is under tank pressure 54.

Pump regulator 30 is fed with the system pressure by line 31 and delivers a pump regulating pressure on line 32. The system pressure fed by way of line 31 acts on a regulating and control piston 33. A force is applied to the control piston 33 from the left by an adjustable spring 34. Operating fluid present in the control space 35 at the right hand end of the control piston 33 reaches a longitudinal bore 37 through a throttling restriction 36. Bore 37 terminates in a transverse bore 38 from where the operating fluid reaches an annular recess 39. Annular recess 39 produces the pump regulating pressure on line 32. A control edge 40 at the control piston 33 permits the pump regulating pressure to be adjusted. According to the present invention, the flow will be guided with system pressure into the section chamber 26, flow is supplied at pump regulating pressure to section chamber 27 and, in section chamber 28, tank pressure prevails.

Figure 4:
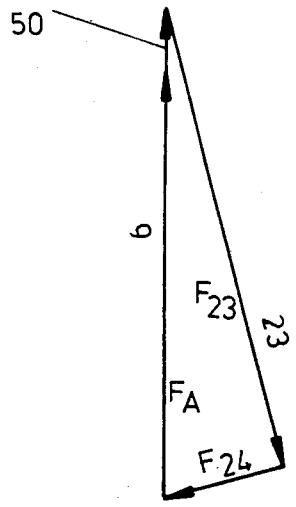
FIG. 4 is a force diagram at zero supply of fluid by the pump according to FIGS. 1 and 2.

Since the operating force $F_A$ exerted on the inner jacket surface 6 of the cam ring 1—see also FIGS. 3 and 4—acts essentially vertically upwards, section chamber 26 extends essentially in the upper range of the outside jacket surface 7 of the cam ring 1. Section chamber 27 which is acted upon by the pump regulating pressure extends subsequently thereto partly in the upper area and partly in the lower area of the outside jacket surface 7 of the cam ring 1.

Furthermore in the lower area of the cam ring 1, preferably in the 6 o'clock position, an elastic support in the form of a compression spring 50 is seated in housing 3, and acts perpendicularly upwards and presses against cam ring 1. Spring 50 may engage, for example, by means of a spring plate with the cam ring 1. The spring 50 with its end facing away from the cam ring 1 is seated in a screw element 51, which is screwed into the housing 3 to adjust the elastic force.

Furthermore and preferably adjacent to sealing element 20, a stop elements is provided on housing 3 to support cam ring 1 in its position lying farthest to the left and as shown in FIG. 1. This preferably adjustable stop elements exerts a force $F_G$ on cam ring 1 preferably about the 9 o'clock position. In the embodiment of FIG. 1, section chamber 26 thus extends between the 9 o'clock position and the 1:30 o'clock position, the section chamber 27 extends between the 1:30 o'clock position and the 4 o'clock position, while the section chamber 28 extends between the 4 o'clock position and the 9 o'clock position. The position of the cam ring 1 depicted in FIG. 3, is its position lying farthest to the left where the stop element S exerts the force $F_G$. The cam ring 1 is shown in FIG. 4 to have lifted off the stop element S. During the start of compression the cam ring 1 is movable in the vertical direction in accordance with system pressure incident thereon.

When the pump is in a state of equilibrium—see FIG. 3—the operating force $F_A$ essentially acts outwardly onto the cam ring 1. The following forces act inwardly on the cam ring 1: the force $F_G$ of the stop elements, the force $F_{23}$ produced by the system pressure in section chamber 26, the pump regulating pressure force $F_{24}$ and finally the force $F_{50}$, i.e., the force exerted by the spring 50. The force produced by the tank pressure in section chamber 28 may be neglected.

According to the invention, as shown in FIG. 2, a connection to the discharge kidney or discharge line 17 is provided by a channel 53 running in top 11 in order thus to conduct the system pressure to the section chamber 26. The sealing elements 20, 21, 22 are arranged so that the total force acting vertically from the outside onto the cam ring 1 is greater than the operating force $F_A$ acting on the inside. The differential force is absorbed by the spring 50. By selection of the spring constant of spring 50, the cam ring 1 can be adjusted in such a way that, for every pressure, adjustment of the cam ring 1 for noise will be optimal. Essentially, a change of the adjustment in height of the cam ring 1 dependent on the pump regulating pressure (and thus on the conveying position of the pump) is caused by the force $F_{24}$ exerted by the vertical component on the section 24. The zero position at the same time may be changed by the screw element 51.

FIGS. 3 and 4 show a plan for applied forces at the cam ring 1. FIG. 4 shows a force diagram for zero supply of fluid by the pump. FIG. 3 shows a force diagram for the pump at supply of maximum fluid by the pump. Operating force $F_A$ exerted on inside jacket surface 6 of cam ring 1 will not only be compensated by two hydrostatic forces, namely $F_{23}$ and $F_{24}$, but will even be over compensated, so that when pumping full, beside the force $F_G$, the force of the spring $F_{50}$ is also necessary. While for conventional pumps the operating force $F_A$ is absorbed by a height adjusting screw, according to the present invention, the operating force $F_A$ will be absorbed by hydrostatic force, preferably by forces $F_{23}$ and $F_{24}$.

The remaining differential force of spring $F_{50}$ will be absorbed, which means that the cam ring 1 passes along a path determined by the differential force and the spring constant of spring 50. This must be the case, because the pump pushes cam ring 1 down further with increasing system pressure. The pre-compression or the beginning of compression must be advanced for higher system pressure, which is accomplished by the setting of the cam ring 1 in a downward direction.

While, for example, in the case of a system pressure of 10 bar, the cam ring 1 lies only 2/100 mm deeper than the rotor 2, in the case of a system pressure of 160 bar, the cam ring 1 lies approximately ½ mm lower than the rotor. This displacement of about ½ mm is produced by excess force dependent on the system pressure and coming from above. Whenever, therefore, the pressure is zero, then the spring 50 relaxes, while whenever the pressure rises, the excess force acting from above becomes greater and thus presses cam ring 1 downwards. An additional spring (not shown in FIG. 1) in approximately 3 o'clock position is preferably supported in the housing 3 and presses the cam ring in the rest position of the pump into the position shown in FIG. 1.

Figure 5:
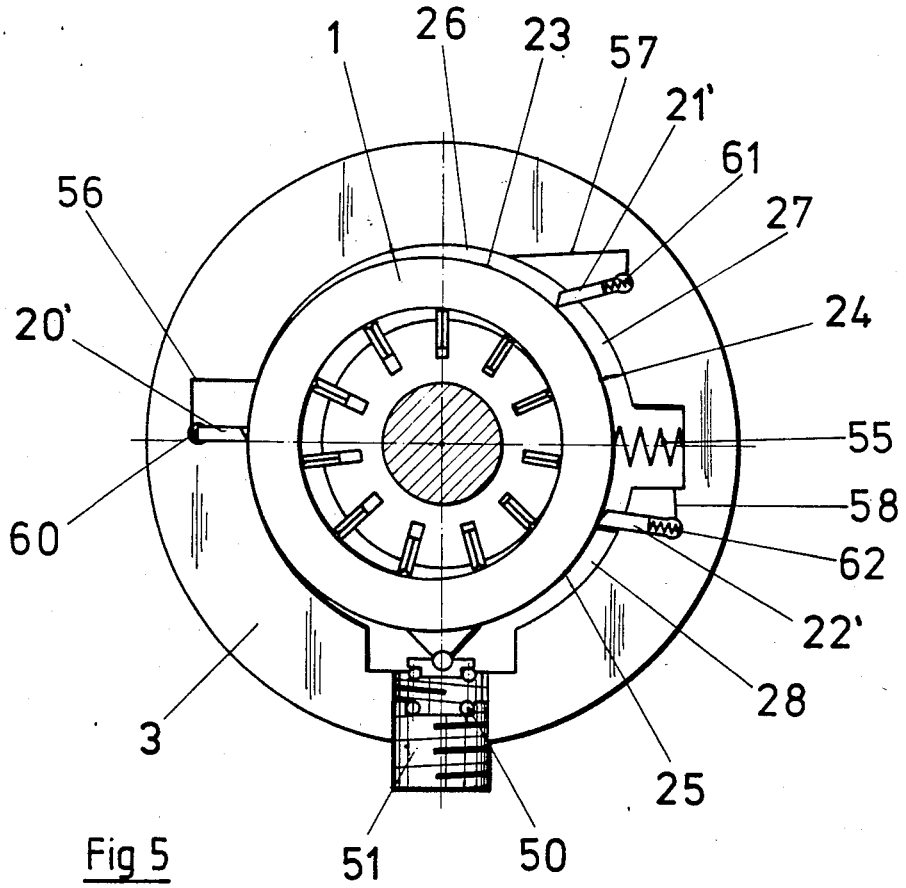
FIG. 5 is a cross-section through a vane pump according to the first embodiment, whereby pressure equilization lines and regulating springs are shown.

FIG. 5 refers to the same embodiment by way of example as FIG. 1, but shows additionally a few important details. Thus, for example, the spring 55 located in 3 o'clock position is shown. The sealing elements corresponding to the sealing elements 20 to 22, have been designated by 20', 21' and 22'. The sealing elements 20', 21' and 22' are seated in the bores extending into housing 3, to the closed ends of which pressure equalization lines 56, 57, 58, lead. The other ends of elements 20', 21' and 22' connect with the section chambers 26 or 27. Preferably, compression springs 60, 61 and 62 also act on the ends of the sealing elements seated in the housing bores to maintain an effective seal.

Figure 6:
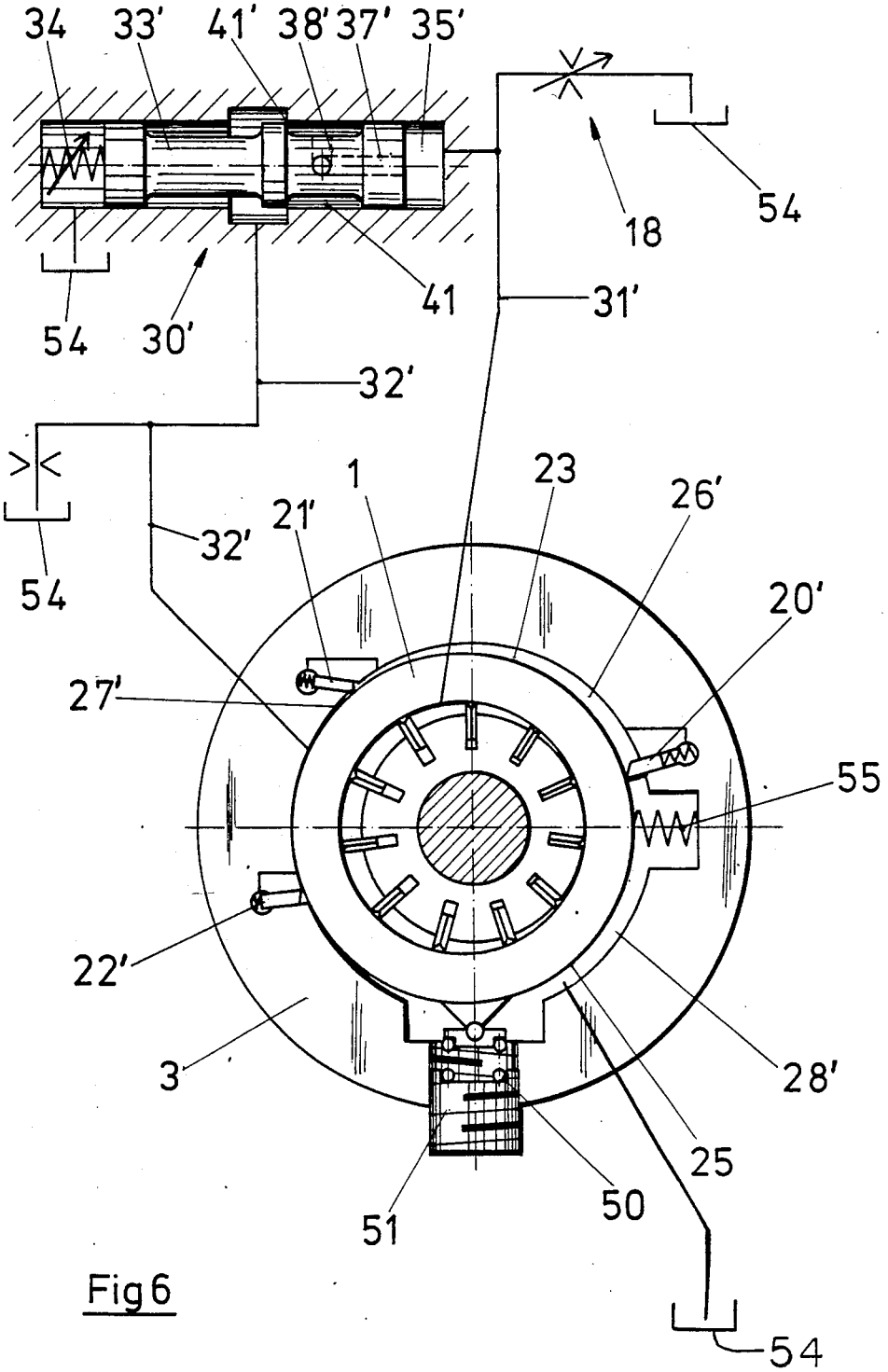
FIG. 6 shows a cross-section through a vane pump according to a second embodiment of the invention.

FIG. 6 shows a second embodiment of the invention with a vane pump essentially developed as in FIGS. 1 to 5. In the embodiment of FIGS. 1 to 5, the section chamber 26 is under system pressure, the section chamber 27 under pump regulating pressure and the section chamber 28 under tank pressure. Since in the case of rising system pressure, the cam ring 1 must move to the right, the pump regulating pressure in the section chamber 27 in FIGS. 1 to 5 was provided in such a way that the pressure in chamber 27 became smaller with rising system pressure. In FIG. 6, the inverse is true. The pump regulator 30' is developed such and is connected with the vane pump such that in the case of rising system pressure, a rising pump regulator pressure will also be delivered by way of line 32' to section chamber 27'. In FIG. 6 the corresponding construction elements are designated with the same reference numbers as in the case of the first embodiment.

In FIG. 6 the pump regulator 30' is fed by way of line 31' with operating fluid under system pressure. The system pressure operates from the right hand on the control piston 33' of the pump regulator 30', whereas a spring 34 acts from the left. Operating fluid present in the control space 35' reaches an annular recess 41 by a longitudinal bore 37' and a traverse bore 38'. A control edge 41' at the control piston 33' permits adjustment of the pump regulating pressure in line 32' to a certain value. Line 32' is connected with tank 54 by a throttle.

Sealing elements 20', 21' and 22' are provided as in FIG. 1 and are equipped with pressure equalizing lines as well as pressure springs. The sealing elements form section chamber 26', 27' and 28'. The section chamber 26' has system pressure and the section chamber 28' has tank pressure. The section chamber 27' is disposed almost opposite section chamber 27 in FIGS. 1 and 5 and has pump regulating pressure. However, pump regulator pressure rises with rising system pressure. Correspondingly, the sealing elements are disposed in approximately the following positions: the sealing element 20' is at 2 o'clock position, the sealing element 22' is at 8 o'clock position and the sealing element 21' is at 10:30 o'clock position.

Figure 7:
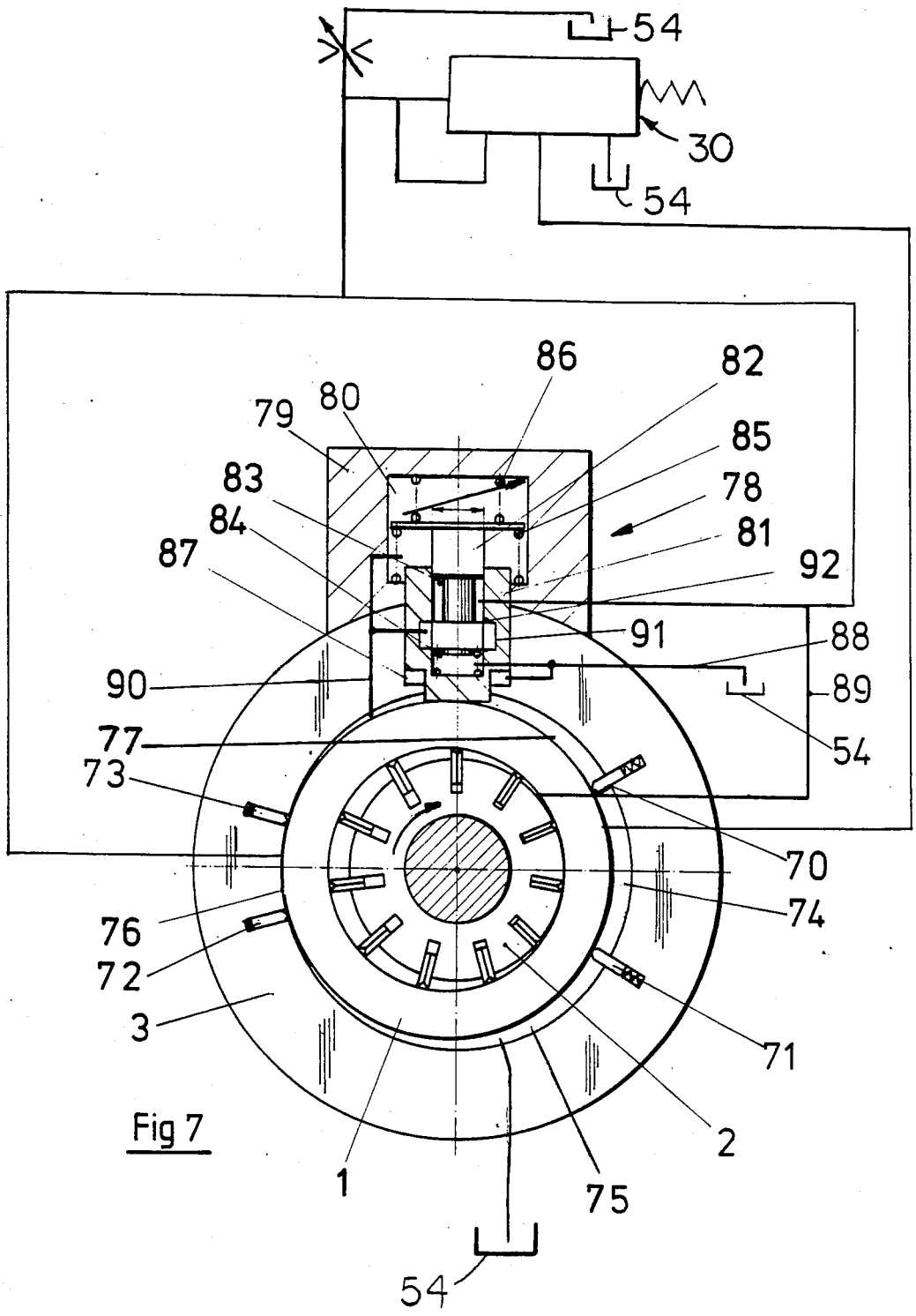
FIG. 7 shows a cross-section through a vane pump according to a third embodiment of the invention.

FIG. 7 shows a third embodiment of the invention with a cam ring 1 and within cam ring 1 a rotor 2 of a vane pump disposed within a pump housing 3. Four sealing elements 70 to 73 are disposed radially in sliding relation in pump housing 3. Sealing elements 70 to 73 form four section chambers 74, 75, 76 and 77. Section chamber 75 is at tank pressure and section chamber 76 at system pressure. The system pressure in section chamber 76 acts on a relatively small surface between the two sealing elements 72 and 73. The section chamber 77 is at control pressure derived from the system pressure. The section chamber 74, similarly to FIG. 1, is at pump regulating pressure, as has already been described above for the FIG. 1 embodiment. In FIG. 7, the spring 50 according to FIG. 1 may be avoided and the control 78 employed in its place.

Control 78 consists of a housing 79 attachable to the pump housing 3 and with a hollow space 80. In a circular, cylindrical bore of the housing 3, as well as between the guide surfaces of the housing 79, a control casing is disposed movably up and down. Control casing 81 scans with its lower end the position or the level of the cam ring 1. In a circular, cylindrical bore of the control casing 81, a piston 82 is disposed which may be moved back and forth. Piston 82 has an annular recess 83, and, from below, is under the pressure of a spring 84. From above, the piston 82 is loaded with a differential force, which results from the difference of two springs 85 and 86 acting against one another. The space containing the spring 84 in the control casing 81 and an annular space 87 are connected with tank 54 by line 88. System pressure is applied to the annular recess 83 by line 89. Control 78 delivers a control pressure to the section chamber 77 derived from the system pressure by line 90, in the same fashion as spring 50. Line 90 is in connection with a recess 91 adjacent to the lower end of the piston and to the recess 80 adjacent to the upper end of piston 82. Spring 86 may be developed adjustably so that piston 82 is held in a given position by the two oppositely acting springs 85 and 86 and the pressure—which is proportional to the system pressure—prevailing in the space 80 or 77 at that position.

Control 78 moves cam ring 1 downwards with rising system pressure and upwards with falling pressure. This is accomplished according to the invention in that shiftable control casing 81 continuously scans the position of the cam ring 1 and compares it with the position of piston 82. Whenever the control casing 81, because of rising system pressure, is shifted upwards, then an increased pressure is fed by line 90 to the section chamber 77 since one of the two control edges of the piston 82 which is designated by reference number 92, permits the passage of operating fluid under system pressure from the annular recess 83 to the recess 91 and from there to line 90. The increased pressure then moves the cam ring downwards. For dropping system pressure, the reverse occurs, i.e., the cam ring 1 is moved upwards as the lower control edge of piston 82 permits operating fluid from line 90 to run to tank 54.

Figure 8:
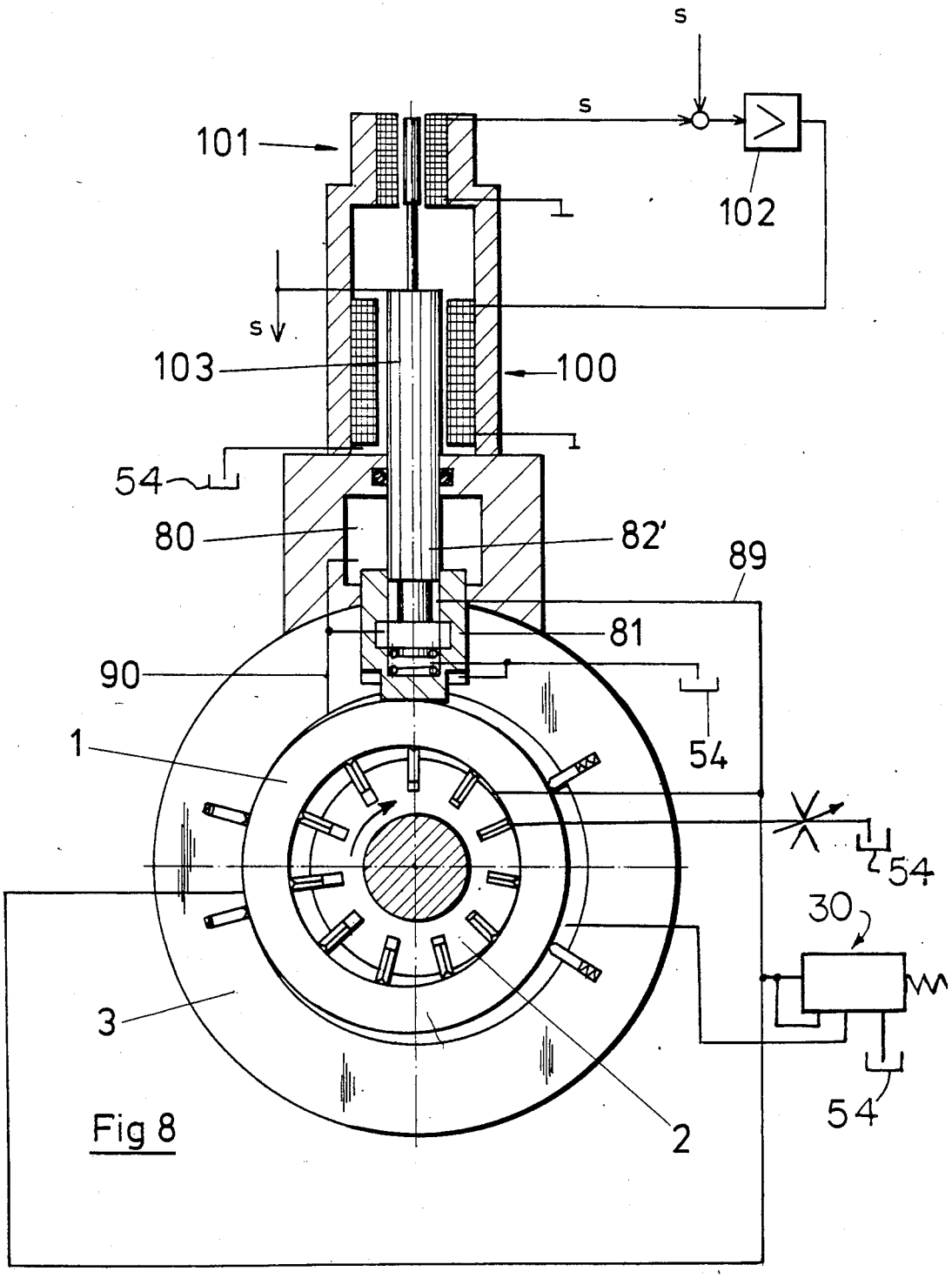
FIG. 8 shows a cross-section through a vane pump according to a fourth embodiment of the invention.

In FIG. 8, a fourth embodiment of the invention is shown which is similar to FIG. 7. Parts corresponding to one another are designated with the same reference number, but are provided with a prime. Contrary to the embodiment of FIG. 7, the positioning of the piston 82' is not accomplished by springs but by a proportional magnet 100. Preferably, a motion pickup 101 is provided which delivers an actual signal $S_A$, which is compared to a theoretical or desired signal $S_D$. This comparative value is fed by way of a regulating amplifier 102 to the proportional magnet 100 so that the latter passes through a certain range S and shifts the piston 82' correspondingly. Piston 82' and anchor 103 may be developed as one element. Whenever, as is shown, an inductive motion pickup is used, then the anchor of the inductive motion pickup 101 can be integral with anchor 103 and piston 82'.

Although the invention has been described previously on the basis of embodiments by way of example all of which relate to a vane pump, the invention is equally applicable to rotary piston pumps.

What is claimed is:

1. A pump for the conveyance of hydraulic operating fluid comprising:

a housing;

a rotor mounted rotatably in said housing;

a plurality of pumping means carried by said rotor;

an adjustable cam ring movable in two directions orthogonal to each other having an inside and an outside jacket and being disposed to surround said rotor;

said cam ring being subjected to an operating force $F_A$, said operating force being generated by system pressure outwardly on said cam ring;

first support means for supporting said cam ring in different positions, which correspond to different amounts of fluid being conveyed, by means of the hydraulic operating fluid acting directly onto said outside jacket of said cam ring at a pump regulating pressure, said pump regulating pressure being derived from the system pressure and being applied in a first direction for moving the cam ring into different positions along the first direction; and second support means for supporting said cam ring and for providing adjustment of the start of compression depending on the system pressure by means of the hydraulic operating fluid acting directly onto said outside jacket of said cam ring in a second direction which is substantially orthogonal to said first direction.

2. A pump as in claim 1 wherein variable hydraulic pressures are applied to said cam ring.

3. A pump as in claim 1 wherein said applying means includes a plurality of sealing elements between the cam ring and the inside wall of the housing for forming a plurality of sections.

4. A pump as in claim 3 wherein said sealing elements are disposed in the inside wall of the housing and fit sealingly with free ends against the outside of the cam ring and are guided sealingly on the side walls of the housing.

5. A pump as in claim 1 wherein at least two section chambers are defined, whereby in one chamber the system pressure prevails and in another a variable pump regulating pressure.

6. A pump as in claim 5 wherein the section chamber at system pressure is defined in such a way on the outside of the cam ring that the force exerted by the system pressure on the cam ring runs essentially opposite to the pressure produced by the operating fluid on the inside jacket surface.

7. A pump as in claim 6 wherein the section chamber at pump regulating pressure is adjacent to the system pressure-section chamber.

8. A pump as in claim 6 wherein pump regulating pressure acts essentially in such a direction on the cam ring that said cam ring is forced into its position corresponding to the maximum quantities of pump conveyance.

9. A pump as in claim 6 further including a spring in the section chamber for the pump regulating pressure for applying a force to the outside jacket of the cam ring so that said cam ring is forced into its position corresponding to the maximal quantity of pump conveyance.

10. A pump as in claim 1 further including pressure absorbing means for exerting a force on the cam ring essentially in the same direction as the force which is produced by the system pressure on the inside jacket surface of the lifting ring.

11. A pump as in claim 10 wherein said pressure absorbing means are springs.

12. A pump as in claim 10 wherein said pressure absorbing means are means defining a further section chamber.

13. A pump as in claim 1 wherein the section chambers are disposed such that the forces acting perpendicularly from outside on the cam ring are greater than the force acting on the inner jacket surface of the cam ring.

14. A pump as in claim 13 including a spring for absorbing the differential force.

15. A pump as in claim 1 further including an adjustable element for the change of the zero position in the form of a screw element holding a spring.

16. A pump as in claim 1 wherein for the feeding in of the system pressure the outlet is connected by way of a channel provided in the housing.

17. A pump as in claim 1 wherein the pump regulating pressure is derived by a regulator.

18. A pump as in claim 1 wherein the outside jacket surface of the cam ring is subdivided into four section chambers.

19. A pump as in claim 18 wherein the subdivision is accomplished by four sealing elements.

20. A pump as in claim 19 wherein the sealing elements are mounted shiftably in the housing.

21. A pump as in claim 19 wherein the sealing elements are resilient.

22. A pump as in claim 19 wherein the sealing elements are under the pressure of a spring.

23. A pump in claim 19 wherein the sealing elements in the housing are in bores and in that pressure equalizing lines connect the ends of the bores lying in the inside of the housing with the pertinent section chamber.

24. A pump as in claim 1 wherein the pump regulating pressure acts essentially in such a direction on the cam ring that the latter is forced into its position corresponding to minimal quantity of pump conveyance.

25. A pump as in claim 1 wherein the sealing elements have variable angles of incidence as against the outside jacket surface of the cam ring.

26. A pump as in claim 1 further including control means for scanning the position of the cam ring and preparing the position corresponding to the scanned position through the working or through the control fluid.

27. A pump as in claim 26 wherein the control means has a control casing and a piston disposed therein providing a two-edge regulation.

28. A pump as in claim 27 wherein the piston is under pressure from both sides of a spring, whereby on one side are provided two adjustable springs acting against each other.

29. A pump as in claim 27 wherein the position of the piston is changed proportionally to the system pressure by a change of the pressure in the space as a result of which the adjustment in the level of height of the cam ring is changed in dependence on system pressure.

30. A pump as in claim 26 wherein control means scans the position of the cam ring in a section chamber and feeds or draws off the hydraulic control fluid from the scanned chamber in a controlled manner.

31. A pump as in claim 26 further including a piston disposed with its one end in the control casing and with its other end connected with a proportional magnet.

32. A pump as in claim 31 further including a motion pickup for delivering the position of the piston in the form of a signal comparable with a theoretical signal in order then to use the comparative value for the control of the proportional magnet.

* * * * *